US005406892A

United States Patent [19]

Kilpatrick et al.

[11] Patent Number: 5,406,892

[45] Date of Patent: Apr. 18, 1995

[54] PAPERBOARD PALLET WITH HALF STRINGERS

[75] Inventors: Ted D. Kilpatrick, Ponte Vedra Beach, Fla.; Arthur M. Wagner, Geneva, Ill.

[73] Assignee: Jefferson Smurfit Corporation, St. Louis, Mo.

[21] Appl. No.: 213,925

[22] Filed: Mar. 15, 1994

[51] Int. Cl.[6] ..... B65D 19/00

[52] U.S. Cl. ..... 108/51.3; 108/56.3

[58] Field of Search ..... 108/51.3, 51.1, 56.1, 108/56.3

[56] References Cited

U.S. PATENT DOCUMENTS

| | | | |
|---|---|---|---|
| 2,444,183 | 6/1948 | Cahners | 108/51.3 |
| 2,446,914 | 8/1948 | Fallert et al. | 108/51.3 |
| 2,576,715 | 11/1951 | Farrell | 108/51.3 |
| 2,609,136 | 9/1952 | Sider | 108/51.3 X |
| 2,728,545 | 12/1955 | Hermitage | 108/56.3 X |
| 3,434,435 | 3/1969 | Achermann et al. | 108/51.3 |
| 3,659,534 | 5/1972 | Childs | 108/51.3 |
| 3,752,089 | 8/1973 | Bartels | 108/51.3 X |
| 4,102,525 | 7/1978 | Albano | 108/51.3 X |
| 4,792,325 | 12/1988 | Schmidtke | 108/51.3 X |
| 4,867,074 | 9/1989 | Quasnick | 108/51.3 |
| 4,979,446 | 12/1990 | Winebarger | 108/56.1 X |
| 5,001,991 | 3/1991 | Smith | 108/51.3 |
| 5,339,746 | 8/1994 | Vannatta | 108/56.3 |
| 5,365,857 | 11/1994 | Kilpatrick et al. | 108/51.3 |

*Primary Examiner*—Jose V. Chen

*Attorney, Agent, or Firm*—Dressler, Goldsmith, Shore & Milnamow, Ltd.

[57] ABSTRACT

A predominantly paperboard pallet comprises longitudinally extending outer stringers, made from an intermediate article folded from a corrugated paperboard sheet so as to have a lower panel and six panels on each side of a vertical plane bisecting the lower panel. On each side thereof, an outer panel extends upwardly and outwardly from the lower panel, an outer panel extends inwardly from the upwardly and outwardly extending panel, to the bisecting plane, an inner panel extends downwardly from the inwardly extending panel, approximately to the lower panel, an inner panel overlies the lower panel and extends outwardly from the downwardly extending panel, to the upwardly and outwardly extending panel, an inner panel extends upwardly and inwardly, to the downwardly extending panel, and an inner panel underlies the inwardly extending panel and extends outwardly, to the upwardly and outwardly extending panel. The underlying panel is secured adhesively to the inwardly extending panel. The overlying panel is secured adhesively to the lower panel. The lower panel is severed longitudinally, at the bisecting plane, so as to provide the outer stringers. Each outer stringer has two side panels provided by the upwardly and downwardly extending panels of the intermediate article, from one side of the bisecting plane, and a lower panel provided by a severed portion of the lower panel. A preferred embodiment further comprises a middle stringer, an upper sheet with two outer flaps, and a lower sheet with two outer flaps.

19 Claims, 1 Drawing Sheet

PAPERBOARD PALLET WITH HALF STRINGERS

TECHNICAL FIELD OF THE INVENTION

This invention pertains to a pallet made predominantly of paperboard material, such as corrugated paperboard, and employing two longitudinally extending outer stringers. This invention contemplates that the outer stringers are made from an intermediate article folded from a single sheet of paperboard material so as to have various panels, one of which is severed longitudinally so as to provide the outer stringers that may be conveniently called half stringers.

BACKGROUND OF THE INVENTION

Usage of shipping pallets made predominantly of corrugated paperboard material is widespread, primarily because of their low cost, recyclability, and cleanliness. Typically, such pallets employ longitudinally extending, transversely spaced stringers, which are made from folded pieces of corrugated paperboard, which include two outer stringers, and which may include a middle stringer. Such pallets also may employ decking sheets including upper sheets secured adhesively to the upper edges of the respective stringers and lower sheets secured adhesively to the lower edges of the respective stringers. The decking sheets may have outer flaps secured adhesively to the outer stringers.

Predominantly paperboard pallets employing stringers, upper sheets with outer flaps, and lower sheets with lower flaps, as noted above, are available commercially from Gate Pallet Systems, Inc. of Crown Point, Ind., under its PAYLOAD trademark.

Pallets of related interest are disclosed in Cahners U.S. Pat. No. 2,444,183, Fallert et al. U.S. Pat. No. 2,446,914, Achermann et al. U.S. Pat. No. 3,434,435, and Childs U.S. Pat. No. 3,659,534.

A pallet of an improved design is disclosed in U.S. patent application Ser. No. 08/119,726 filed Sep. 10, 1993, and assigned commonly herewith. As illustrated and described therein, an upper decking sheet is folded to form two outer stringers of the improved pallet, which also may have a lower decking sheet.

The pallet illustrated and described therein may be advantageously used in an application requiring a narrow pallet but employing a fork lift having widely spaced blades, which may need to enter the pallet longitudinally. Thus, if the pallet has a transverse dimension of about thirty inches and if each outer stringer has a transverse width of about one and one-half inches, fork lift blades spaced by nearly twenty-seven inches at their outer edges can enter the pallet longitudinally for lifting and moving the pallet without damaging the pallet.

This invention has resulted from efforts to provide an improved pallet that can be advantageously used in such an application.

SUMMARY OF THE INVENTION

This invention provides an improved pallet comprising two longitudinally extending outer stringers, each of which is made from an intermediate article folded from a single sheet of paperboard material so as to have various panels, one of which is severed longitudinally so as to provide the outer stringers, which may be conveniently called half stringers. As described below, the intermediate article is folded so as to have multiple panels on each side of a generally vertical plane and a lower panel intersected by the generally vertical plane.

The panels on each side of the generally vertical plane include two outer panels. As attached at a fold in the sheet to the lower panel of the intermediate article, one outer panel extends upwardly from the lower panel of the intermediate article. As attached at a fold in the sheet to the upwardly extending outer panel, another outer panel extends inwardly from the same panel, toward and approximately to the generally vertical plane. The upwardly extending panels of the intermediate article may extend outwardly as well as upwardly from the lower panel of the intermediate article.

The panels on each side of the generally vertical plane further include at least one additional panel bracing and reinforcing the intermediate article. If there are at least two such bracing and reinforcing panels, at least one may be adhesively secured to one of the other panels. If there are at least three such bracing and reinforcing panels, at least two may be adhesively secured each to one of the other panels.

A preferred arrangement comprising four inner panels is contemplated. As attached at a fold in the sheet to the inwardly extending outer panel in the preferred arrangement, one inner panel extends downwardly from the same panel, toward and approximately to the lower panel. As attached at a fold in the sheet to the downwardly extending inner panel in the preferred arrangement, another inner panel overlies the lower panel and extends outwardly from the same panel, toward and approximately to the upwardly extending outer panel. As attached at a fold in the sheet to the inner panel overlying the lower panel in the preferred arrangement, another inner panel extends upwardly and inwardly from the same panel, toward and approximately to the downwardly extending inner panel and the inwardly extending outer panel. As attached at a fold in the sheet to and extending outwardly from the upwardly and inwardly extending inner panel in the preferred arrangement, another inner panel underlies the inwardly extending outer panel and extends toward and approximately to the upwardly extending outer panel.

The lower panel of the intermediate article is severed longitudinally, approximately at the generally vertical plane, so as to provide the outer stringers. Each outer stringer thus has two side panels provided respectively by the upwardly and downwardly extending panels of the intermediate article, from one side of the generally vertical plane, and a lower panel provided by a severed portion of the lower panel of the intermediate article.

On each side of the generally vertical plane, the underlying inner panel may be adhesively secured to the inwardly extending outer panel, and the overlying outer panel may be adhesively secured to the lower panel.

The pallet may further comprise an upper sheet of paperboard material, the upper sheet being secured adhesively to the outer stringers. Preferably, the upper sheet has a main portion and two outer flaps folded downwardly from the main portion, and the upper sheet is secured adhesively to the outer stringers between the main portion of the upper sheet and the inwardly extending outer panel of each outer stringer and between each outer flap of the upper sheet and a selected one of the side panels of a respective one of the outer stringers.

Along with the upper sheet noted above, the pallet may further comprise a lower sheet of paperboard material, the lower sheet being secured adhesively to the outer stringers. Preferably, the lower sheet has a main portion and two outer flaps folded upwardly from the main portion, and the lower sheet is secured adhesively to the outer stringers between the main portion of the lower sheet and the lower panel of each outer stringer and between each outer flap of the lower sheet and the selected one of the side panels of a respective one of the outer stringers.

Preferably, the selected one of the side panels is provided by the downwardly extending panel of the intermediate article, from one side of the generally vertical plane. Thus, if the upwardly extending panels of the intermediate article extend outwardly as well as upwardly from the lower panel of the intermediate article, the improved pallet may have a rectangular profile.

The improved pallet may further comprise a longitudinally extending middle stringer spaced between the outer stringers. The middle stringer may be similar to the intermediate article, except that the lower panel of the middle stringer is not severed longitudinally, and except that the downwardly extending inner panels of the middle stringer are secured adhesively to each other.

This invention also provides a pallet stringer folded from a single sheet of paperboard material, such as corrugated paperboard, so as to have side panels similar to the side panels of one of the outer stringers noted above and so as to have inner panels similar to the inner panels of one of the outer stringers noted above.

These and other objects, features, and advantages of this invention are evident from the following description of a preferred embodiment of this invention with reference the accompanying drawings.

DETAILED DESCRIPTION OF PREFERRED EMBODIMENT

Figure 1:
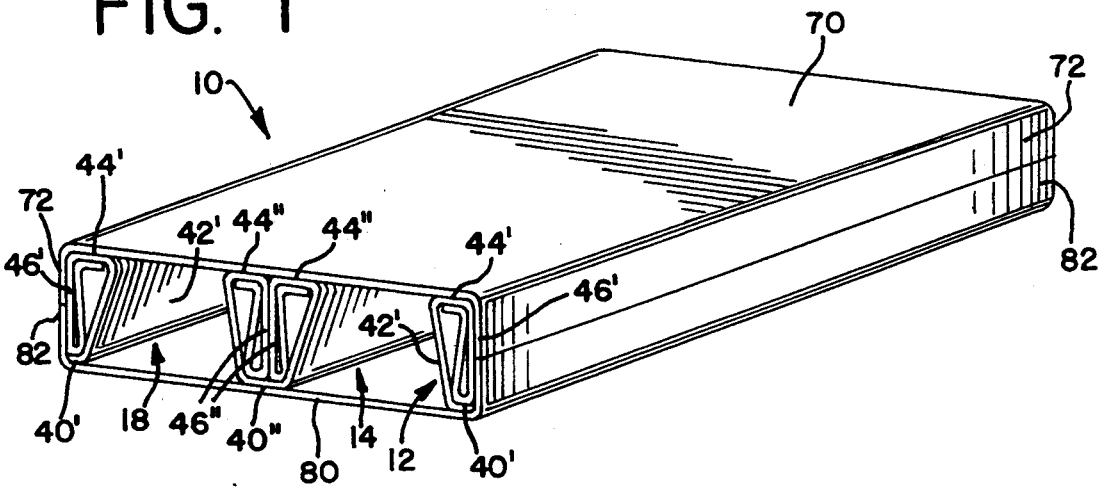
FIG. 1 is a perspective view of a predominantly paperboard pallet comprising two outer stringers, an upper sheet with two outer flaps, and a lower sheet with two outer flaps and constituting a preferred embodiment of this invention.

As shown in FIG. 1, a pallet 10 made predominantly of corrugated paperboard constitutes a preferred embodiment of this invention. Generally, the pallet 10 comprises two outer stringers 12, a middle stringer 14, an upper sheet 16 of corrugated paperboard, and a lower sheet 18 of corrugated paperboard. This invention contemplates that the outer stringers 12 are made from an intermediate article 20 shown in FIG. 2.

The middle stringer 14, the upper sheet 16, the lower sheet 18, and the intermediate article 20 is folded from a single sheet of double wall, corrugated paperboard, which may be tape-reinforced or fiber-reinforced. Single wall, corrugated paperboard or multi-ply paper may be alternatively used.

Herein, directional terms including "upper", "lower", "vertical", "horizontal", "upwardly", "downwardly", "inwardly", and "outwardly" refer to the pallet 10 and the stringers 12, 14, in preferred orientations, in which they are shown. The pallet 10 and the stringers 12, 14, would be also useful in inverted orientations. Usage of such directional terms is not intended to restrict this invention to the preferred orientation.

Figure 2:
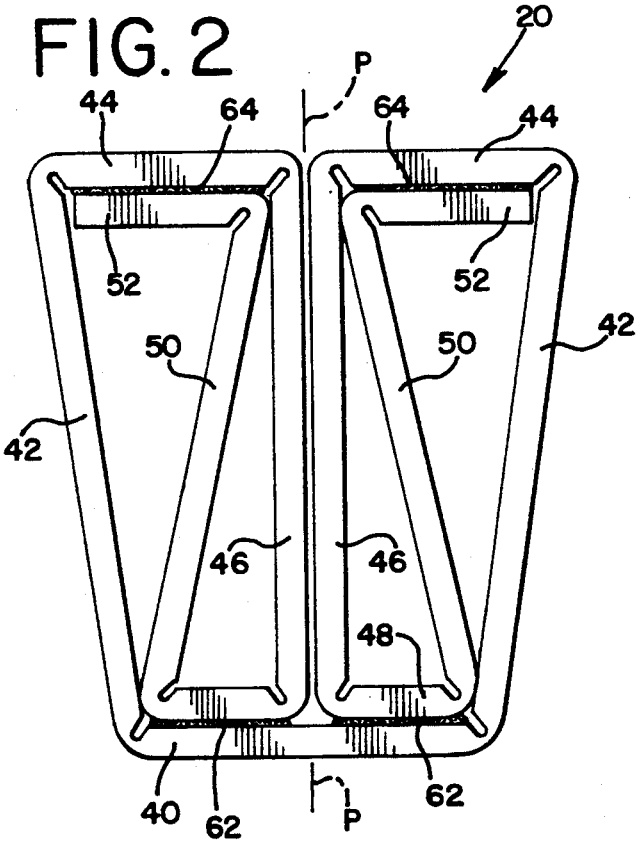
FIG. 2 is an enlarged, profile view of an intermediate article, from which the outer stringers are made.
Figure 3:
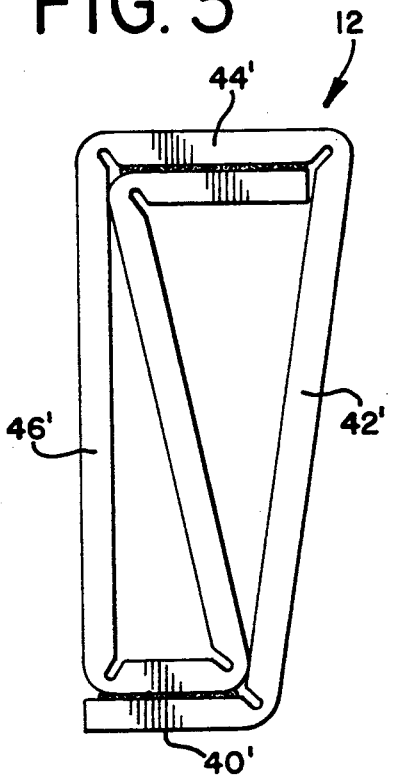
FIG. 3 is a similar, profile view of one of the outer stringers, as made from the intermediate article.

As shown in FIG. 2, the intermediate article 20 is folded so as to have thirteen panels, namely six panels on each side of an imaginary, generally vertical plane P and a generally horizontal, lower panel 40, which is intersected by the plane P. Also, as shown in FIG. 3, the lower panel 40 is bisected by the plane P. Preferably, as shown, the improved stringer 10 is folded along parallel folding lines extending in a transverse direction relative to flutes of the single sheet of corrugated paperboard.

On each side of the plane P, an outer panel 42 extends upwardly and outwardly from the lower panel 40, extending at an obtuse angle relative to the lower panel 40. Also, an outer panel 44 is attached at a fold in the sheet to the upwardly and outwardly extending panel 42 and extends inwardly from the same panel 42, extending toward and approximately to the plane P. Further, an inner panel 46 is attached at a fold in the sheet to the inwardly extending outer panel 44 and extends downwardly from the same panel 44, extending toward and approximately to the lower panel 40. Moreover, an inner panel 48 is attached at a fold in the sheet to the downwardly extending inner panel 46 and extends outwardly from the same panel 46, overlying the lower panel 40 and extending toward and approximately to the upwardly and outwardly extending outer panel 42. Moreover, an inner panel 50 is attached at a fold in the sheet to the outwardly extending inner panel 48 and extends upwardly and inwardly from the same panel 48, extending toward and approximately to the downwardly extending inner panel 46 and the inwardly extending outer panel 44. Furthermore, an inner panel 52 is attached at a fold in the sheet to the upwardly and inwardly extending inner panel 50 and extends outwardly from such panel 50, underlying the inwardly extending outer panel 44 and extending to and approximately toward the upwardly and outwardly extending outer panel 42.

On each side of the plane P, the outwardly extending inner panel 48 overlying the lower panel 40 is secured adhesively to the lower panel 40, in a wide region 62. On each side of the plane P, the outwardly extending inner panel 52 underlying the inwardly extending outer panel 44 is secured adhesively to the same panel 44, in a wide region 64. The adhesive regions 62, 64, extend along substantially the entire length of the intermediate article 20.

The lower panel 40 is severed longitudinally, approximately at the generally vertical plane P, so as to provide the outer stringers 12. As indicated by a dashed line in FIG. 2, the lower panel 40 may be advantageously perforated along its entire length and approximately at the generally vertical plane P, so as to facilitate severing of the lower panel 40.

In FIGS. 1 and 3, primed reference numbers and double-primed reference numbers are used to refer to panels that are similar to panels referenced by similar, unprimed reference numbers in FIG. 2, except as illustrated and described herein.

As exemplified by the outer stringer 12 shown in FIG. 3, each outer stringer 12 thus has two side panels 42', 46' which are provided by respectively by the aforenoted panels 42, 46, of the intermediate article 20, from one side of the generally vertical plane P. Moreover, each outer stringer 12 has an upper panel 44', which is provided by the inwardly extending outer panel 44 of the intermediate article 20, and a lower panel 40', which is provided by a severed portion of the lower panel 40 of the intermediate article 20. Because each outer stringer 12 is comprised of one half of the lower panel 40 of the intermediate article 20, together with the outer and inner panels from one side of the generally vertical plane P, the outer stringers 12 may be conveniently called half stringers.

The middle stringer 14 is similar to the intermediate article 20, except that the lower panel 40" of the middle stringer 14 is not severed longitudinally, and except that the downwardly extending inner panels 46" of the middle stringer 14 are secured adhesively to each other. The middle stringer 14 has two panels 44", which define the upper edge of the middle stringer 14, and which are similar to the inwardly extending outer panels 44 of the intermediate article 20. The lower panel 40" defines the lower edge of the middle stringer 14. The middle stringer 14 is similar, therefore, to the pallet stringer illustrated and described in U.S. patent application Ser. No. 08/179,111 filed Jan. 10, 1994, and assigned commonly herewith. The disclosure of U.S. patent application Ser. No. 08/179,111 is incorporated herein by reference.

The upper sheet 16 has a main portion 70 and two outer flaps 72, which are folded downwardly from the main portion 70. The lower sheet 18 has a main portion 80 and two outer flaps 82, which are folded upwardly from the main portion 80. Along each of the outer stringers 12, one of the outer flaps 72 of the upper sheet 16 and one of the outer flaps 82 of the lower sheet 18 approximate each other but do not overlap each other, as shown in FIG. 1.

The upper sheet 16 is secured adhesively to the outer stringers 12, between the main portion 70 and the panels 44' defining the upper edges of the outer stringers 12 and between each outer flap 72 and a selected one of the side panels 42', 46', of a respective one of the outer stringers 12. Also, the upper sheet 16 is secured adhesively to the middle stringer 14, between the main portion 72 and the panels 44" defining the upper edge of the middle stringer 14.

The lower sheet 18 is secured adhesively to the outer stringers 12, between the main portion 80 and the panels 40' defining the lower edges of the outer stringers 12 and between each outer flap 82 and the selected one of the side panels 42', 46', of a respective one of the outer stringers 12. Also, the lower sheet 18 is secured adhesively to the middle stringer 14, between the main portion 82 and the panel 40" defining the lower edge of the middle stringer 14.

Preferably, as shown, the selected one of the side panels 42', 44', is the side panel 46'. Consequently, as shown, the pallet 10 has a generally rectangular profile. However, if the selected one of the side panels 42', 46', is the side panel 46' the main portion 70 of the upper sheet 16 would have to be transversely wider than the main portion 70 of the lower sheet 18 so that the pallet 10 would have a generally trapezoidal profile.

Preferably, where adhesive securement is specified above, a so-called "cold melt" or "cold set" adhesive is used, such as Code No. 3715 or Code No. 3715B, both of which are available commercially from H. B. Fuller Co. of Palatine, Ill.

The pallet 10 illustrated and described therein may be advantageously used in an application requiring a narrow pallet but employing a fork lift having widely spaced blades, which may need to enter the pallet 10 longitudinally. Thus, if the pallet 10 has a transverse dimension of about thirty inches and if each outer stringer has a transverse width of about one and one-half inches where widest, fork lift blades spaced by nearly twenty-seven inches (which is conventional) at their outer edges can enter the pallet 10 longitudinally for lifting and moving the pallet 10 without damaging the pallet 10.

Although the pallet 10 employs an upper sheet 16 and a lower sheet 18, decking members of a type dislosed in Schmidtke U.S. Pat. No. 4,792,325, Quasnick U.S. Pat. No. 4,867,074, and Smith U.S. Pat. No. 5,001,991 may be alternatively or additionally employed.

Various other modifications may be made in the preferred embodiment described above without departing from the scope and spirit of this invention.

We claim:

1. A pallet comprising two longitudinally extending outer stringers, each of which is made from an intermediate article folded from a single sheet of paperboard material so as to have at least thirteen panels including at least six panels on each side of a generally vertical plane and a lower panel intersected by the generally vertical plane, wherein the panels on each side of the generally vertical plane include (a) an outer panel attached at a fold in the sheet to and extending upwardly from the lower panel of the intermediate article, (b) an outer panel attached at a fold in the sheet to and extending inwardly from the upwardly extending outer panel, and extending toward and approximately to the generally vertical plane, (c) an inner panel attached at a fold in the sheet to and extending downwardly from the inwardly extending outer panel, and extending toward and approximately to the lower panel, (d) an inner panel attached at a fold in the sheet to and extending outwardly from the downwardly extending inner panel, overlying the lower panel, and extending toward and approximately to the upwardly extending outer panel, (e) an inner panel attached at a fold in the sheet to and extending upwardly and inwardly from the inner panel overlying the lower panel, and extending toward and approximately to the downwardly extending inner panel and the inwardly extending outer panel, and (f) an inner panel attached at a fold in the sheet to and extending outwardly from the upwardly and inwardly extending inner panel, underlying the inwardly extending outer panel, and extending toward and approximately to the upwardly extending outer panel, and wherein the lower panel of the intermediate article is severed longitudinally, approximately at the generally vertical plane, so as to provide the outer stringers, each of which thus has two side panels provided respectively by the upwardly and downwardly extending panels of the intermediate article, from one side of the generally vertical plane, and each of which thus has a lower panel provided by a severed portion of the lower panel of the intermediate article.

2. The pallet of claim 1 wherein the inner panel underlying the inwardly extending outer panel is secured adhesively to the inwardly extending outer panel, on each side of the generally vertical plane, and wherein the inner panel overlying the lower panel is secured adhesively to the lower panel, on each side of the generally vertical plane.

3. The pallet of claim 2 further comprising an upper sheet of paperboard material, the upper sheet being secured adhesively to the outer stringers.

4. The pallet of claim 3 wherein the upper sheet has a main portion and two outer flaps folded downwardly from the main portion and wherein the upper sheet is secured adhesively to the outer stringers between the main portion and the inwardly extending outer panel of each outer stringer and between each outer flap and a selected one of the side panels of a respective one of the outer stringers.

5. The pallet of claim 4 wherein the selected one of the side panels is provided by the downwardly extending panel of the intermediate article, from one side of the generally vertical plane.

6. The pallet of claim 3 wherein the upwardly extending panels of the intermediate article extend outwardly as well as upwardly from the lower panel of the intermediate article.

7. The pallet of claim 3 further comprising a lower sheet of paperboard material, the lower sheet being secured adhesively to the outer stringers.

8. The pallet of claim 7 wherein the lower sheet has a main portion and two outer flaps folded upwardly from the main portion, and wherein the lower sheet is secured adhesively to the outer stringers between the main portion and the lower panel of each outer stringer.

9. The pallet of claim 7 wherein the upper sheet has a main portion and two outer flaps folded downwardly from the main portion, wherein the upper sheet is secured adhesively to the outer stringers between the main portion of the upper sheet and the inwardly extending outer panel of each outer stringer and between each outer flap of the upper sheet and a selected one of the side panels of a respective one of the outer stringers, wherein the lower sheet has a main portion and two outer flaps folded upwardly from the main portion, and wherein the lower sheet is secured adhesively to the outer stringers between the main portion of the lower sheet and the inwardly extending outer panel of each outer stringer and between each outer flap of the lower sheet and the selected one of the side panels of the respective one of the outer stringers.

10. The pallet of claim 9 wherein the selected one of the side panels is provided by the downwardly extending panel of the intermediate article, from one side of the generally vertical plane.

11. The pallet of claim 10 wherein the selected one of the side panels is provided by the downwardly extending panel of the intermediate article, from one side of the generally vertical plane.

12. The pallet of claim 11 wherein the upwardly extending panels of the intermediate article extend outwardly as well as upwardly from the lower panel of the intermediate article.

13. The pallet of claim 12 further comprising a longitudinally extending middle stringer spaced between the outer stringers and secured adhesively to the main portions of the upper and lower sheets.

14. The pallet of claim 13 wherein the middle stringer is similar to the intermediate article, except that the lower panel of the middle stringer is not severed longitudinally, and except that the downwardly extending inner panels of the middle stringer are secured adhesively to each other.

15. A pallet comprising two longitudinally extending outer stringers, each of which is made from an intermediate article folded from a single sheet of paperboard material so as to have at least thirteen panels including at least four panels on each side of a generally vertical plane and a lower panel intersected by the generally vertical plane, wherein the panels on each side of the generally vertical plane include (a) an outer panel attached at a fold in the sheet to and extending upwardly from the lower panel of the intermediate article, (b) an outer panel attached at a fold in the sheet to and extending inwardly from the upwardly extending outer panel, and extending toward and approximately to the generally vertical plane, (c) an inner panel attached at a fold in the sheet to and extending downwardly from the inwardly extending outer panel, and extending toward and approximately to the lower panel, and (d) at least one additional panel bracing and reinforcing the intermediate article, wherein the lower panel is severed longitudinally to provide the outer stringers.

16. A pallet comprising two longitudinally extending outer stringers, each of which is made from an intermediate article folded from a single sheet of paperboard material so as to have at least thirteen panels including at least five panels on each side of a generally vertical plane and a lower panel intersected by the generally vertical plane, wherein the panels on each side of the generally vertical plane include (a) an outer panel attached at a fold in the sheet to and extending upwardly from the lower panel of the intermediate article, (b) an outer panel attached at a fold in the sheet to and extending inwardly from the upwardly extending outer panel, and extending toward and approximately to the generally vertical plane, (c) an inner panel attached at a fold in the sheet to and extending downwardly from the inwardly extending outer panel, and extending toward and approximately to the lower panel, and (d) at least two additional panels bracing and reinforcing the intermediate article and including at least one panel secured adhesively to one of the outer and inner panels, wherein the lower panel is severed longitudinally to provide the outer stringers.

17. A pallet comprising two longitudinally extending outer stringers, each of which is made from an intermediate article folded from a single sheet of paperboard material so as to have at least thirteen panels including at least six panels on each side of a generally vertical plane and a lower panel intersected by the generally vertical plane, wherein the panels on each side of the generally vertical plane include (a) an outer panel attached at a fold in the sheet to and extending upwardly from the lower panel of the intermediate article, (b) an outer panel attached at a fold in the sheet to and extending inwardly from the upwardly extending outer panel, and extending toward and approximately to the generally vertical plane, (c) an inner panel attached at a fold in the sheet to and extending downwardly from the inwardly extending outer panel, and extending toward and approximately to the lower panel, and (d) at least three additional panels bracing and reinforcing the intermediate article and including at least two panels secured adhesively to others of the outer and inner panels, wherein the lower panel is severed longitudinally to provide the outer stringers.

18. A pallet stringer folded from a single sheet of paperboard material so as to have a lower panel, a side panel attached at a fold in the sheet to and extending upwardly from the lower panel, an upper panel attached at a fold in the sheet to and extending inwardly from the upwardly extending side panel, a side panel attached at a fold in the sheet to and extending downwardly from the inwardly extending upper panel, and extending toward and approximately to the lower panel, an inner panel attached at a fold in the sheet to and extending outwardly from the downwardly extending side panel, overlying the lower panel, and extending toward and approximately to the upwardly extending outer panel, an inner panel attached at a fold in the sheet to and extending upwardly and inwardly from the inner panel overlying the lower panel, and extending toward and approximately to the downwardly extending inner panel and the inwardly extending outer panel, and an inner panel attached at a fold in the sheet to and extending outwardly from the upwardly and inwardly extending inner panel, underlying the inwardly extending outer panel, and extending toward and approximately to the upwardly extending side panel.

19. The pallet stringer of claim 18 wherein the inner panel underlying the upper panel is secured adhesively to the upper panel and wherein the inner panel overlying the lower panel is secured adhesively to the lower panel.

* * * * *